US009648941B1

(12) United States Patent
Gonzalez

(10) Patent No.: US 9,648,941 B1
(45) Date of Patent: May 16, 2017

(54) MAGNETIC TOOL BELT AND WRIST STRAP KIT

(71) Applicant: Sergio Gonzalez, West Park, FL (US)

(72) Inventor: Sergio Gonzalez, West Park, FL (US)

( * ) Notice: Subject to any disclaimer, the term of this patent is extended or adjusted under 35 U.S.C. 154(b) by 0 days.

(21) Appl. No.: 14/945,808

(22) Filed: Nov. 19, 2015

(51) Int. Cl.
*A45F 5/02* (2006.01)

(52) U.S. Cl.
CPC ..... *A45F 5/02* (2013.01)

(58) Field of Classification Search
CPC ..... A45F 5/00; A45F 2200/0575; A45F 2005/008; A45F 2005/023; A41D 13/0012; B25H 3/00
USPC ..... 224/183
See application file for complete search history.

(56) References Cited

U.S. PATENT DOCUMENTS 3,886,508 A 5/1975 Lavrard
5,707,333 A * 1/1998 Bakst ..... A61N 2/06 600/15
6,530,508 B1 * 3/2003 Devine ..... A45F 5/00 224/183
7,032,250 B1 * 4/2006 Davis ..... A41D 13/0012 2/102
7,146,651 B1 12/2006 Lapin
8,516,621 B2 8/2013 Woolery
2004/0173484 A1 * 9/2004 Bates ..... A41D 13/0012 206/349
2006/0011679 A1 * 1/2006 Santiago ..... B25H 3/00 224/222
2007/0006367 A1 * 1/2007 Newman ..... A45F 3/12 2/338
2010/0193557 A1 * 8/2010 Clinton ..... A45F 3/02 224/576

* cited by examiner

*Primary Examiner* — Corey Skurdal
(74) *Attorney, Agent, or Firm* — Stevenson IP, LLC

(57) ABSTRACT

A magnetic tool belt and wrist strap kit including length-adjustable, padded waist belt and wrist strap bodies, each having a centered portion with tapered portions on each side thereof. Magnets arranged within each body permit magnetic attachment of ferrous hand tools and related hardware and accessories in a wide variety of locations, angles, and positions thereon. Vertical tubes on a front side of the waist belt body permit storage of screwdrivers or similar items therein. An attachable u-shaped frame centrally disposed on the front side of the waist belt body is provided to support a plaster mud pan thereon.

10 Claims, 4 Drawing Sheets

MAGNETIC TOOL BELT AND WRIST STRAP KIT

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of magnetic tool holders are known in the prior art. Some of the tool holders include magnets coupled to the outer surface for holding work items while other magnetic tool holders have magnet configurations which limit the attachment of tools at different angles and positions on the tool holder. At least one known tool holder provides a holder which is attachable to a belt, but does not contain magnets in the belt itself. However, what is needed is a magnetic tool belt and wrist strap kit providing length-adjustable, padded holders for ferrous hand tools and related hardware and accessories with the holders to be worn around a wearer's waist and wrist, respectively. Each of the waist belt and wrist strap bodies has a centered portion with tapered portions on each side thereof. Magnets arranged within each body permit magnetic attachment of ferrous hand tools and related hardware and accessories in a wide variety of locations, angles, and positions thereon. Vertical tubes on a front side of the waist belt body permit storage of screwdrivers or similar items therein. An attachable u-shaped frame centrally disposed on the front side of the waist belt body is provided to support a plaster mud pan thereon.

FIELD OF THE INVENTION

The present invention relates to magnetic tool holders, and more particularly, to a magnetic tool belt and wrist strap kit.

SUMMARY OF THE INVENTION

The general purpose of the present magnetic tool belt and wrist strap kit, described subsequently in greater detail, is to provide a magnetic tool belt and wrist strap kit which has many novel features that result in a magnetic tool belt and wrist strap kit which is not anticipated, rendered obvious, suggested, or even implied by prior art, either alone or in combination thereof.

To accomplish this, the present magnetic tool belt and wrist strap kit is devised to provide adjustable holders for ferrous hand tools and related hardware and accessories with the holders to be worn around a wearer's waist and wrist, respectively. The present kit includes a length-adjustable waist belt body with internal foam padding and a length-adjustable wrist strap body with internal foam padding devised to provide adjustable holders for ferrous hand tools and related hardware and accessories with the holders to be worn around a wearer's waist and wrist, respectively. The waist belt body has a central portion and tapered right and left portions of each side thereof. The central portion has a triangular upper end having a rounded apex to conform to a center of the wearer's back between the shoulder blades and to eliminate sharp edges that could potentially result in discomfort to the wearer. The wrist strap body has a center portion and tapered first and second portions on each side thereof. A triangular top end of the center portion has a rounded apex to eliminate sharp edges in order to accommodate comfortable wearing of the wrist strap body.

A plurality of magnets disposed within each of the waist belt body and the wrist strap body are provided for magnetically attaching ferrous hand tools and related hardware and accessories thereto. The magnets are arranged and configured to permit a wide variety of hand tools of varying dimensions, as well as and related hardware and accessories, to be secured to each of the waist belt body and the wrist strap body in a wide variety of arrangements thereon. For instance, a machete can be longitudinally secured to the waist belt body on the central portion. In another arrangement, various plastering tools such as a plastering trowel, a hawk, a Stanley knife, and a hammer can be secured via the magnets at various locations, angles, and positions. A pair of aligned adjacent hollow open-ended tubes is vertically disposed on the front side in the right portion to secure screwdrivers or similar items therein. An attachable u-shaped frame centrally disposed on the front side of the waist belt body is provided to support a plaster mud pan thereon.

Each of the waist belt body front and rear sides and each of the wrist strap body forward and rearward sides is cloth. The central portion of the waist belt body has a width in a range of 10 inches to 14 inches. The combined length of the waist belt body and the hook and loop fastener strip has a maximum length in a range of 28 inches to 34 inches. The center portion of the wrist strap body has a width in a range of 3 inches to 6 inches. The combined length of the wrist strap body and the hook and loop fastening strip has a maximum length in a range of 6 inches to 10 inches. Each of an interior side of each of front and rear sides of the waist belt body and an internal side of each of each of a forward and rearward side of the wrist strap body is vinyl. The materials with which the device is constructed provide for comfortable wearing of the device. In addition, each the waist belt body and the wrist strap body can be constructed with materials of varying textures and colors. The waist belt body and the wrist strap body can be hung onto a hook or magnetically attached to a ferrous surface, such as a ferrous door, for storage when not being worn.

Thus has been broadly outlined the more important features of the present magnetic tool belt and wrist strap kit so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
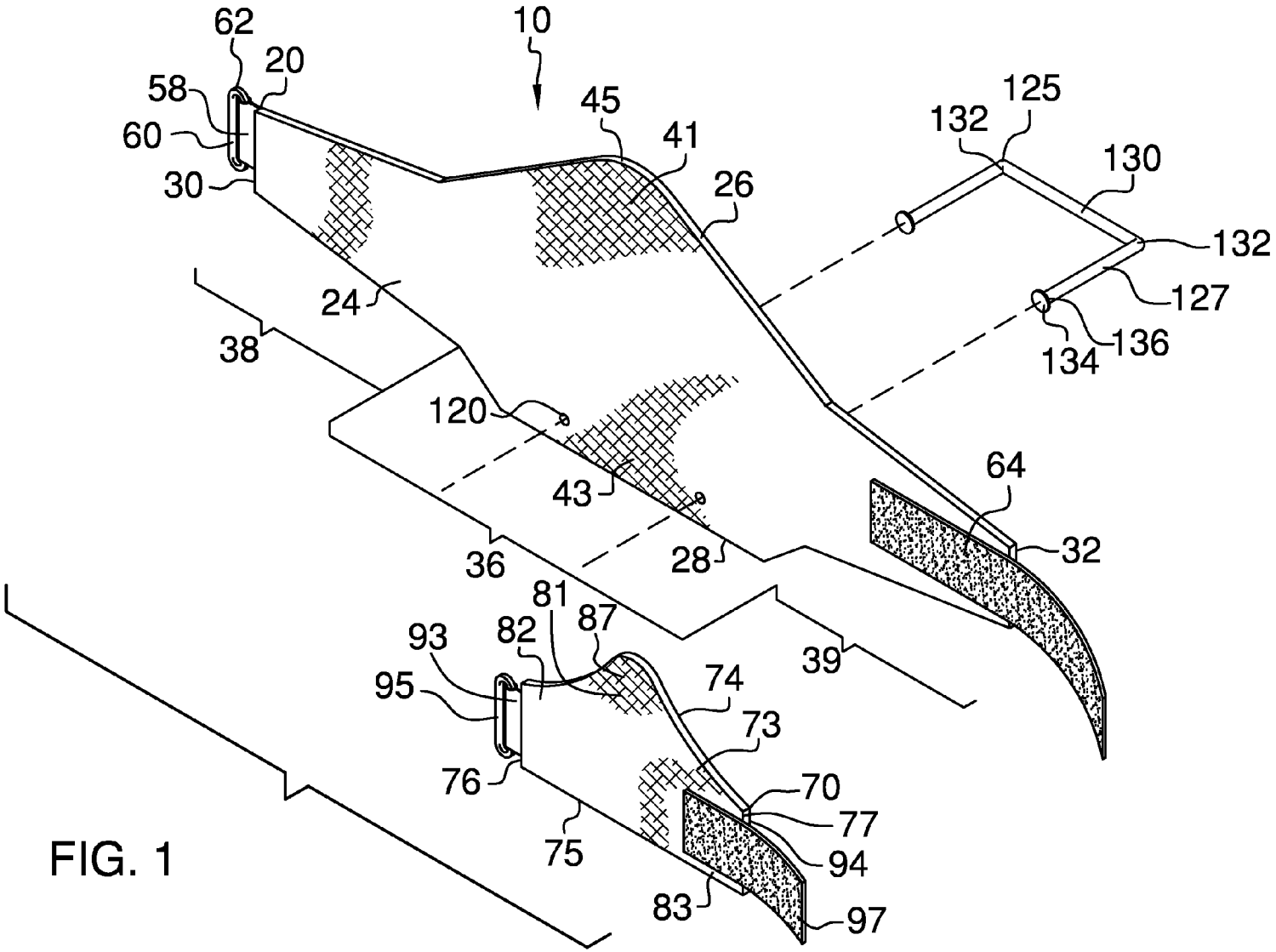
FIG. 1 is a rear isometric view of a tool belt and a wrist strap.
Figure 2:
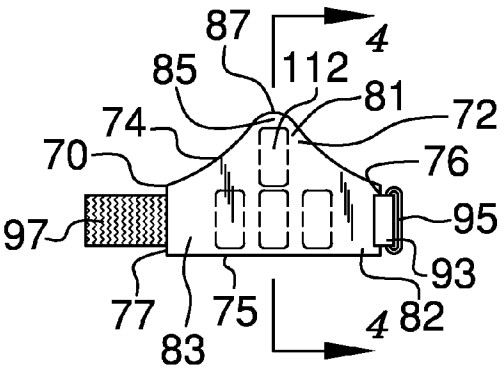
FIG. 2 is a front elevation view of the wrist strap.
Figure 3:
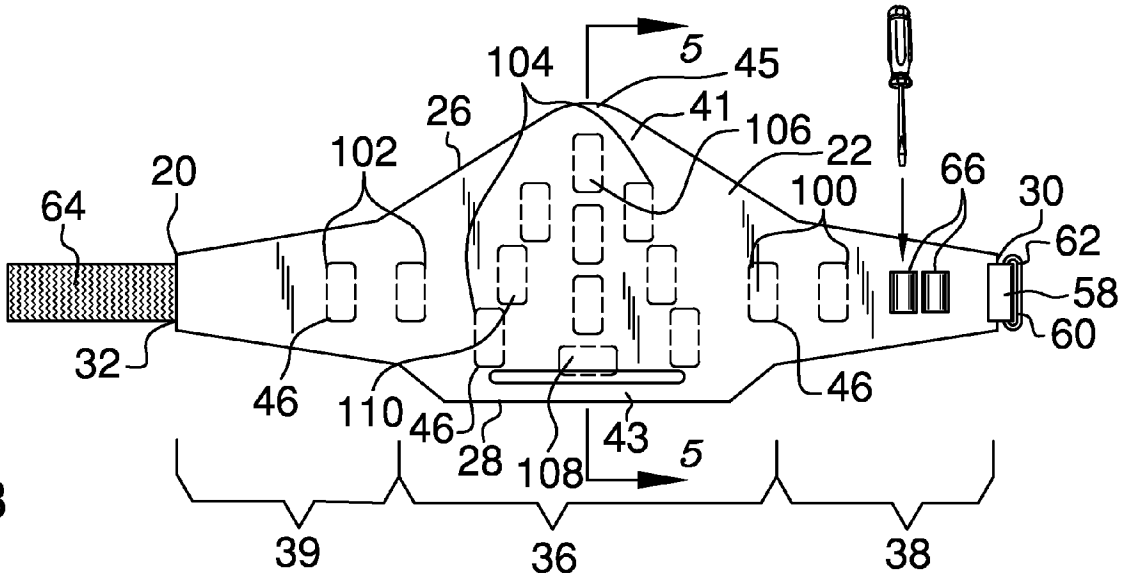
FIG. 3 is a front elevation view of the tool belt.
Figure 4:
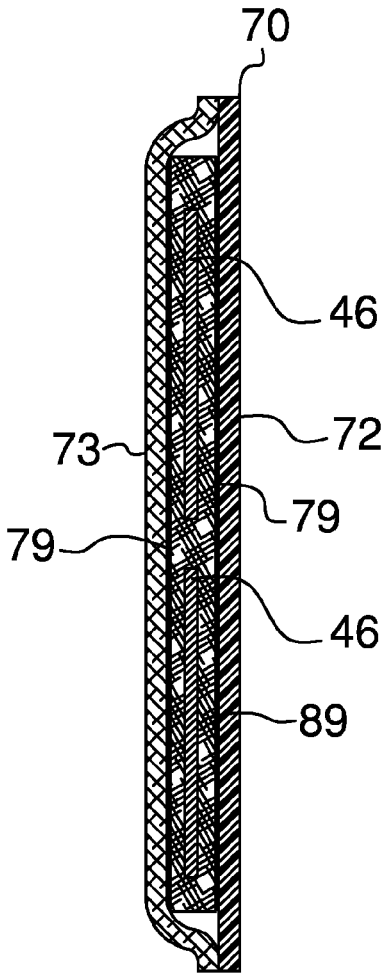
FIG. 4 is a cross-sectional view taken along line 4-4 of FIG. 2.
Figure 5:
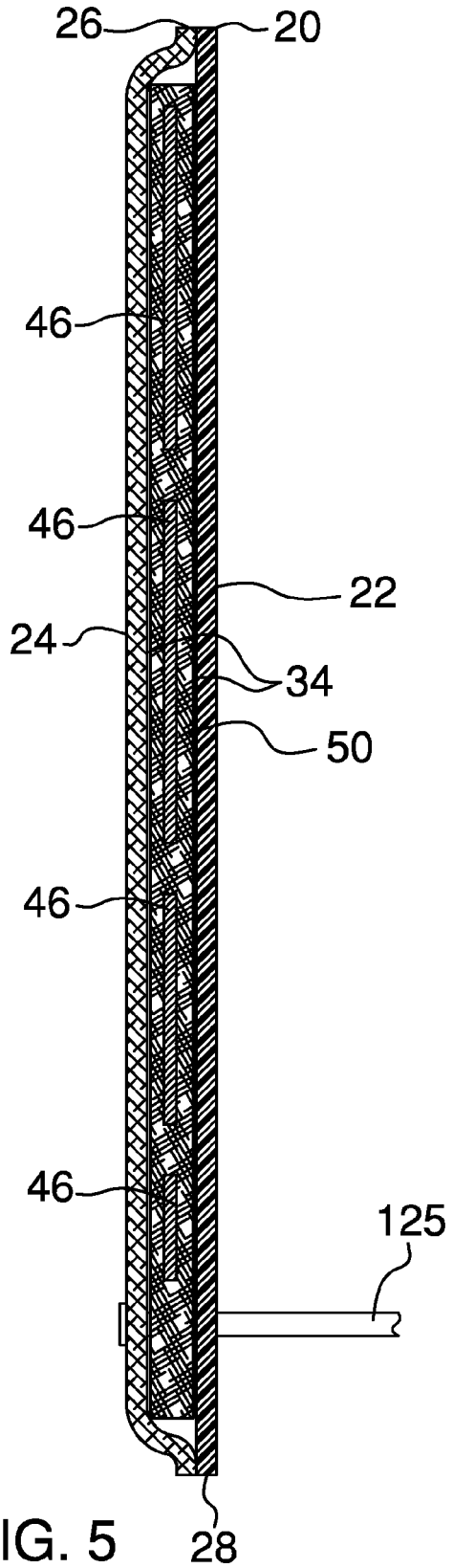
FIG. 5 is a cross-sectional view taken along line 5-5 of FIG. 3.
Figure 6:
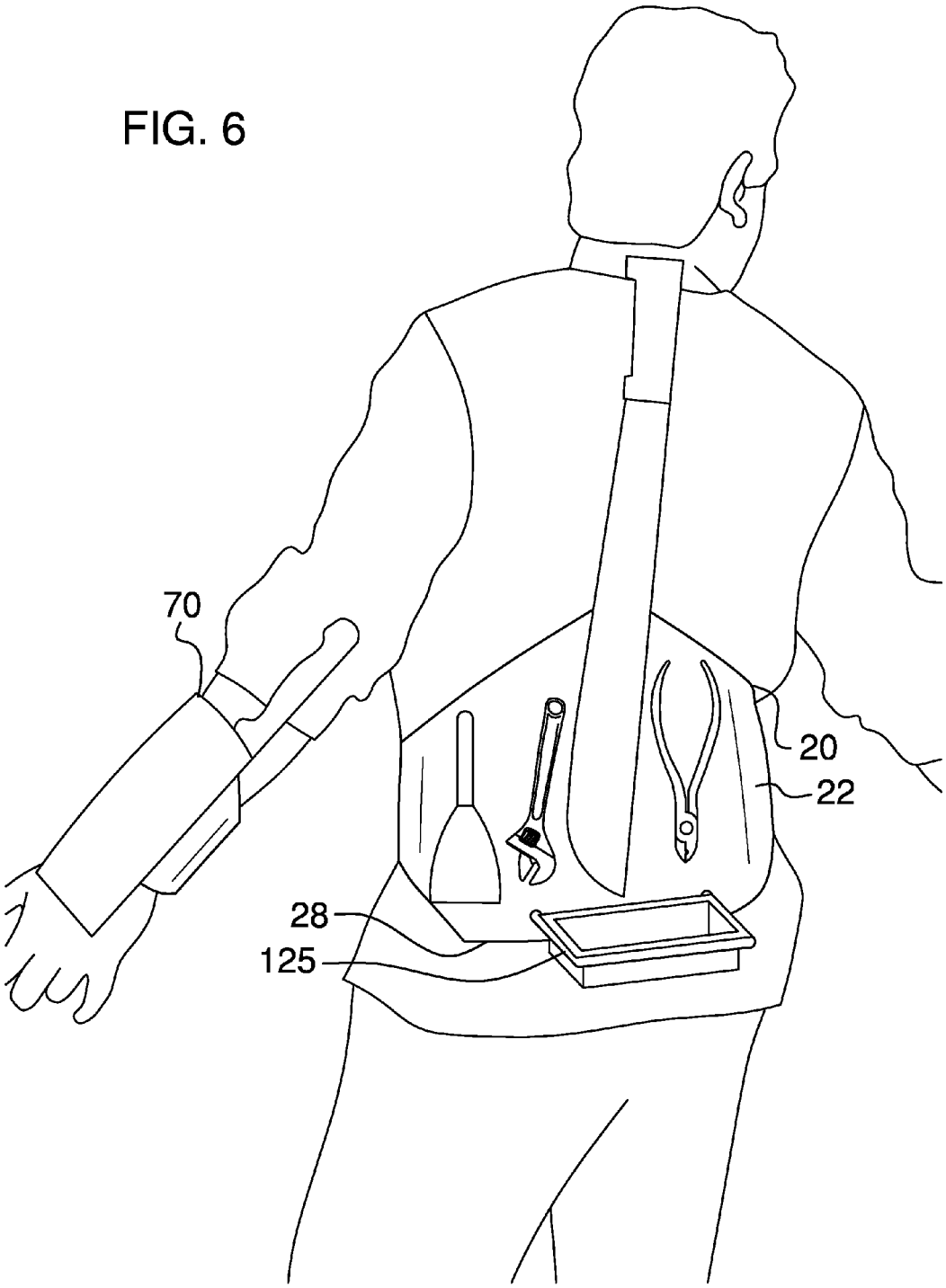
FIG. 6 is an in-use view of the tool belt and the wrist strap.

With reference now to the drawings, and in particular FIGS. 1 through 6 thereof, an example of the instant magnetic tool belt and wrist strap kit employing the principles and concepts of the present magnetic tool belt and wrist strap kit and generally designated by the reference number 10 will be described.

Referring to FIGS. 1 through 6 the present magnetic tool belt and wrist strap kit 10 is illustrated. The magnetic tool belt and wrist strap kit 10 includes a waist belt body 20 and wrist strap body 70 devised to provide adjustable holders for ferrous hand tools and related hardware and accessories with the holders to be worn around a wearer's waist and wrist, respectively. The waist belt body 20 has a front side 22, a rear side 24, a top side 26, a bottom side 28, a right side 30, and a left side 32. Each of the front side 22 and the rear side 24 has an interior side 34. The waist belt body 20 has a central portion 36, a tapered right portion 38 between the central portion 36 and the right side 30, and a tapered left portion 39 between the central portion 36 and the left side 32. Each of the right portion 38 and the left portion 39 has a width wider proximal the central portion 36 than at the respective right side 30 and left side 32. The central portion 38 has a triangular upper end 41 directly adjacent the top side 26 and an inverted bilaterally symmetrical trapezoidal lower end 43 directly adjacent the bottom side 28. The upper end 41 has a rounded apex 45.

A foam padding central layer 50 is continuously disposed directly between the entire interior side 34 of each of the front side 22 and the rear side 24. A plurality of magnets 46, further described below, is disposed within each of the waist belt body 20 and the wrist strap body 70 magnetically attaching ferrous hand tools and related hardware and accessories thereto. Each magnet 46 has a length of approximately 2 inches and a width of approximately 1.5 inches and a depth of approximately 0.50 inches.

A strap 58 is extended from the right side 30. The strap 58 has an outer end 60. A loop member 62 disposed on the outer end 60 of the strap 58. A hook and loop fastener strip 64 is attached to and extends from the left side 32. The hook and loop fastener strip 64 is engageable to the loop member 62. The engagement of the hook and loop fastener strip 64 to the loop member 62 provides adjustability of a combined length of the waist belt body 20 and the hook and loop fastener strip 64.

A pair of aligned adjacent hollow open-ended tubes 66 is vertically disposed on the front side 22 in the right portion 38. Each tube 66 secures a screwdriver therein.

The wrist strap body 70 has a forward side 72, a rearward side 73, an upper side 74, a lower side 75, a right end 76, and a left end 77. Each of the forward side 72 and the rearward side 73 has an internal side 79. The wrist strap body 70 has a center portion 81, a tapered first portion 82 between the center portion 81 and the right end 76, and a tapered second portion 83 of the wrist strap body 70 between the center portion 81 and the left end 77. Each of the first portion 82 and the second portion 83 gradually narrows toward the right end 76 and the left end 77, respectively. The center portion 81 has a triangular top end 85 directly adjacent the upper side 74. The top end 85 has a rounded apex 87.

A foam padded center layer 89 is continuously disposed directly between each of the entire internal side 79 of each of the forward side 72 and the rearward side 73.

The plurality of magnets 46 is disposed within each of the central layer 50 and the center layer 89. The magnets 46 are interiorly disposed to provide more durability and stronger attachment than would be provided if the magnets were disposed an outer surface of the waist belt body 20 and the wrist strap body 70A band 93 extends from the right end 76 and has an exterior end 94. A ring member 95 is disposed on the exterior end 94 of the band 93. A hook and loop fastening strip 97 is attached to and extends from the left end 77. The hook and loop fastening strip 97 is engageable to the ring member 95. The engagement of the hook and loop fastening strip 97 to the ring member 95 provides adjustability of a combined length of the wrist strap body 70 and the hook and loop fastening strip 97. Each of the hook and loop fastener strip 64 and the hook and loop fastening strip 97 facilitate the donning and removal of the respective waist belt body 20 and the wrist strap body 70 from the wearer.

A right group 100 of the plurality of magnets 46 is disposed within the central layer 50 of the waist belt body 20. A left group 102 of the plurality of magnets 46 is disposed within the central layer 50. A center group 104 of the plurality of magnets 46 is disposed within the central layer 50. Each of the right group 100 and left group 102 is horizontally aligned with each other and are disposed proximal the respective right side 30 and left side 32. The center group 104 is arranged in a pyramidal configuration;

In the pyramidal configuration, a top magnet 106 of the center group 104 is centrally disposed proximal the apex 45 of the central portion 41 of the waist belt body 20, a bottom magnet 108 of the center group 104 is centrally disposed proximal the bottom side 28, and at least a pair of the magnets 46 of the center group 104 is centrally disposed between the top magnet 106 and the bottom magnet 108. A trio of side magnets 110 of the center group 104 is aligned proximal the respective right group 100 and left group 102. An upper magnet 112 is disposed within the center layer 89 of the wrist strap body 70 proximal the apex 87 of the center portion 81 upper side 74. A plurality of horizontally aligned lower magnets 114 is centrally disposed within the center layer 89 proximal the lower side 75 of the wrist strap body 70 between the upper magnet 112 and the lower side 75. The placement and configuration of the magnets 46 permits a wide variety of hand tools of varying dimensions, as well as and related hardware and accessories, to be secured to each of the waist belt body 20 and the wrist strap body 70 in a wide variety of arrangements thereon. For instance, a machete can be longitudinally secured to the waist belt body 20 on the central portion 41. In another arrangement, various plastering tools such as a plastering trowel, a hawk, a Stanley knife, and a hammer can be secured via the magnets at various locations, angles, and positions.

A pair of spaced apart holes 120 is centrally disposed in the waist belt body 20 central portion 36 lower end 43 proximal the bottom side 28. A u-shaped frame 125 is centrally disposed on the front side 22 of the waist belt body 20. The frame 125 includes a pair of side arms 127 parallel to each other. A central arm 130 is continuously disposed between an interior end 132 of each of the side arms 127. An attachment member 134 is disposed on an exterior end 136 of each of the side arms 127. The attachment member 134 is configured to secure the interior end 132 of each side arm 127 to the rear side 24 of the waist belt body 20. The frame 125 is sized to support a plaster mud pan thereon. The attachment member 134, as shown, is a disc.

Each of the waist belt body 20 front and rear sides 22, 24 and each of the wrist strap body forward and rearward sides 72, 73 are cloth. The central portion 36 of the waist belt body 20 has a width in a range of 10 inches to 14 inches. The combined length of the waist belt body 20 and the hook and loop fastener strip 64 has a maximum length in a range of 28 inches to 34 inches. The center portion 81 of the wrist strap body 70 has a width in a range of 3 inches to 6 inches. The combined length of the wrist strap body 70 and the hook and loop fastening strip 97 has a maximum length in a range of 6 inches to 10 inches. Each of the waist belt body 20 front and rear sides 22, 24 and each of the wrist strap body 70 forward and rearward sides 72, 73 are cloth. The interior side 24 of each of the front side 22 and the rear side 24 is vinyl. The internal side 79 of each of the forward side 72 and the rearward side 73 is vinyl. The materials with which the device 10 is constructed serve to provide comfortable wearing of the device 10.

What is claimed is:

1. A magnetic tool belt and wrist strap kit comprising:

a waist belt body having a front side, a rear side, a top side, a bottom side, a right side, and a left side, each of the front side and the rear side having an interior side;

a central portion of the waist belt body;

a tapered right portion of the waist belt body between the central portion and the right side;

a tapered left portion of the waist belt body between the central portion and the left side, each of the right portion and the left portion having a width wider proximal the central portion than at the respective right side and left side;

wherein the central portion has a triangular upper end directly adjacent the top side and an inverted bilaterally symmetrical trapezoidal lower end directly adjacent the bottom side, the upper end having a rounded apex;

a foam padding central layer continuously disposed directly between the entire interior side of each of the front side and the rear side;

a foam padded center layer continuously disposed directly between the entire internal side of each of the forward side and the rearward side;

a plurality of magnets disposed within each of the central layer and the center layer;

a strap extended from the right side, the strap having an outer end;

a loop member disposed on the outer end of the strap;

a hook and loop fastener strip attached to and extended from the left side;

a pair of aligned adjacent hollow open-ended tubes vertically disposed on the front side in the right portion, each tube configured to secure a screwdriver therein;

wherein the hook and loop fastener strip is engageable to the loop member;

wherein the engagement of the hook and loop fastener strip to the loop member is configured to provide adjustability of a combined length of the waist belt body and the hook and loop fastener strip;

a wrist strap body having a forward side, a rearward side, an upper side, a lower side, a right end, and a left end, each of the forward side and the rearward side having an internal side;

a center portion of the wrist strap body;

a tapered first portion of the wrist strap body between the center portion and the right end, wherein the first portion gradually narrows toward the right end;

a tapered second portion of the wrist strap body between the center portion and the left end, wherein the second portion gradually narrows toward the left end;

wherein the center portion has a triangular top end directly adjacent the upper side, the top end having a rounded apex;

a band extended from the right end, the band having an exterior end;

a ring member disposed on the exterior end of the band;

a hook and loop fastening strip attached to and extended from the left end;

wherein the hook and loop fastening strip is engageable to the ring member;

wherein the engagement of the hook and loop fastening strip to the ring member is configured to provide adjustability of a combined length of the wrist strap body and the hook and loop fastening strip.

2. The magnetic tool belt and wrist strap kit of claim 1 further comprising:

a right group of the plurality of magnets disposed within the central layer of the waist belt body;

a left group of the plurality of magnets disposed within the central layer;

a center group of the plurality of magnets disposed within the central layer, wherein each of the right group and left group are horizontally aligned with each other and are disposed proximal the respective right side and left side;

wherein the center group is arranged in a pyramidal configuration;

wherein in the pyramidal configuration, a top magnet of the center group is centrally disposed proximal the apex of the central portion of the waist belt body, a bottom magnet of the center group is centrally disposed proximal the bottom side, at least a pair of the magnets of the center group is centrally disposed between the top magnet and the bottom magnet, and wherein a trio of side magnets of the center group is aligned proximal the respective right group and left group;

an upper magnet disposed within the center layer of the wrist strap body proximal the apex of the center portion upper side;

a plurality of horizontally aligned lower magnets centrally disposed within the center layer proximal the lower side of the wrist strap body between the upper magnet and the lower side.

3. The magnetic tool belt and wrist strap kit of claim 1 further comprising:

a pair of spaced apart holes centrally disposed in the waist belt body central portion lower end proximal the bottom side;

a u-shaped frame centrally disposed on the front side of the waist belt body, the frame comprising:

a pair of side arms parallel to each other;

a central arm continuously disposed between an interior end of each of the side arms; and an attachment member disposed on an exterior end of each of the side arms, wherein the attachment member is configured to secure the interior end of each side arm to the rear side of the waist belt body;

wherein the frame is sized to support a plaster mud pan thereon.

4. The magnetic tool belt and wrist strap kit of claim 3 wherein the attachment member is a disc.

5. A magnetic tool belt and wrist strap kit comprising:

a waist belt body having a front side, a rear side, a top side, a bottom side, a right side, and a left side, each of the front side and the rear side having an interior side;

a central portion of the waist belt body;

a tapered right portion of the waist belt body between the central portion and the right side;

a tapered left portion of the waist belt body between the central portion and the left side, each of the right portion and the left portion having a width wider proximal the central portion than at the respective right side and left side;

wherein the central portion has a triangular upper end directly adjacent the top side and an inverted bilaterally symmetrical trapezoidal lower end directly adjacent the bottom side, the upper end having a rounded apex;

a foam padding central layer continuously disposed directly between the entire interior side of each of the front side and the rear side;

a foam padded center layer continuously disposed directly between the entire internal side of each of the forward side and the rearward side;

a plurality of magnets disposed within each of the central layer and the center layer;

a strap extended from the right side, the strap having an outer end;

a loop member disposed on the outer end of the strap;

a hook and loop fastener strip attached to and extended from the left side;

a pair of aligned adjacent hollow open-ended tubes vertically disposed on the front side in the right portion, each tube configured to secure a screwdriver therein;

wherein the hook and loop fastener strip is engageable to the loop member;

wherein the engagement of the hook and loop fastener strip to the loop member is configured to provide adjustability of a combined length of the waist belt body and the hook and loop fastener strip;

a wrist strap body having a forward side, a rearward side, an upper side, a lower side, a right end, and a left end, each of the forward side and the rearward side having an internal side;

a center portion of the wrist strap body;

a tapered first portion of the wrist strap body between the center portion and the right end, wherein the first portion gradually narrows toward the right end;

a tapered second portion of the wrist strap body between the center portion and the left end, wherein the second portion gradually narrows toward the left end;

wherein the center portion has a triangular top end directly adjacent the upper side, the top end having a rounded apex;

a band extended from the right end, the band having an exterior end;

a ring member disposed on the exterior end of the band;

a hook and loop fastening strip attached to and extended from the left end;

wherein the hook and loop fastening strip is engageable to the ring member;

wherein the engagement of the hook and loop fastening strip to the ring member is configured to provide adjustability of a combined length of the wrist strap body and the hook and loop fastening strip;

a right group of the plurality of magnets disposed within the central layer of the waist belt body;

a left group of the plurality of magnets disposed within the central layer;

a center group of the plurality of magnets disposed within the central layer, wherein each of the right group and left group are horizontally aligned with each other and are disposed proximal the respective right side and left side;

wherein the center group is arranged in a pyramidal configuration;

wherein in the pyramidal configuration, a top magnet of the center group is centrally disposed proximal the apex of the central portion of the waist belt body, a bottom magnet of the center group is centrally disposed proximal the bottom side, at least a pair of the magnets of the center group is centrally disposed between the top magnet and the bottom magnet, and wherein a trio of side magnets of the center group is aligned proximal the respective right group and left group;

an upper magnet disposed within the center layer of the wrist strap body proximal the apex of the center portion upper side;

a plurality of horizontally aligned lower magnets centrally disposed within the center layer proximal the lower side of the wrist strap body between the upper magnet and the lower side;

a pair of spaced apart holes centrally disposed in the waist belt body central portion lower end proximal the bottom side;

a u-shaped frame centrally disposed on the front side of the waist belt body, the frame comprising:

a pair of side arms parallel to each other;

a central arm continuously disposed between an interior end of each of the side arms; and an attachment member disposed on an exterior end of each of the side arms, wherein the attachment member is configured to secure the interior end of each side arm to the rear side of the waist belt body;

wherein the frame is sized to support a plaster mud pan thereon.

6. The magnetic tool belt and wrist strap kit of claim 5 wherein the attachment member is a disc.

7. The magnetic tool belt and wrist strap kit of claim 5 wherein each of the waist belt body front and rear sides and each of the wrist strap body forward and rearward sides is cloth.

8. The magnetic tool belt and wrist strap kit of claim 5 wherein the central portion of the waist belt body has a width in a range of 10 inches to 14 inches;

wherein the combined length of the waist belt body and the hook and loop fastener strip has a maximum length in a range of 28 inches to 34 inches;

wherein the center portion of the wrist strap body has a width in a range of 3 inches to 6 inches; and wherein the combined length of the wrist strap body and the hook and loop fastening strip has a maximum length in a range of 6 inches to 10 inches.

9. The magnetic tool belt and wrist strap kit of claim 6 wherein each of the waist belt body front and rear sides and each of the wrist strap body forward and rearward sides are cloth.

10. The magnetic tool belt and wrist strap kit of claim 7 wherein the interior side of each of the front side and the rear side is vinyl; and wherein the internal side of each of the forward side and the rearward side is vinyl.

* * * * *